US010337766B2

(12) United States Patent
Takizawa

(10) Patent No.: US 10,337,766 B2
(45) Date of Patent: Jul. 2, 2019

(54) TWO-STAGE COMPRESSION REFRIGERATION CYCLE

(71) Applicant: DENSO CORPORATION, Kariya, Aichi-pref. (JP)

(72) Inventor: Ryo Takizawa, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/744,008

(22) PCT Filed: Mar. 17, 2016

(86) PCT No.: PCT/JP2016/058601
§ 371 (c)(1),
(2) Date: Jan. 11, 2018

(87) PCT Pub. No.: WO2017/038131
PCT Pub. Date: Mar. 9, 2017

(65) Prior Publication Data

US 2018/0209696 A1 Jul. 26, 2018

(30) Foreign Application Priority Data

Sep. 1, 2015 (JP) ..... 2015-172160

(51) Int. Cl.
*F25B 1/10* (2006.01)
*F25B 1/00* (2006.01)
(Continued)

(52) U.S. Cl.
CPC ..... *F25B 1/10* (2013.01); *F25B 1/00* (2013.01); *F25B 31/004* (2013.01); *F25B 43/02* (2013.01);
(Continued)

(58) Field of Classification Search
CPC .... F25B 1/10; F25B 43/02; F25B 1/00; F25B 31/004
See application file for complete search history.

(56) References Cited

U.S. PATENT DOCUMENTS

2013/0312376 A1* 11/2013 Huff ..... F25B 1/10 55/457

FOREIGN PATENT DOCUMENTS

| | | | |
|---|---|---|---|
| JP | H02213652 | A | 8/1990 |
| JP | 2004085047 | A | 3/2004 |
| JP | 2006170488 | A | 6/2006 |

* cited by examiner

*Primary Examiner* — Emmanuel E Duke
(74) *Attorney, Agent, or Firm* — Harness, Dickey & Pierce, P.L.C.

(57) ABSTRACT

A two-stage pressurizing refrigeration cycle is provide with a suction-side guiding portion in a part of a low-stage side suction pipe that leads from a bypass branch portion, at which a bypass pipe is branched, to a refrigerant suction side of a low-stage compressor. The suction-side guiding portion guides a lubricating oil from the refrigerant suction side of the low-stage side compressor to a side of the bypass branch portion. The suction-side guiding portion is located at a position in a vertical direction that is equal to or higher than apposition in the vertical direction of the bypass branch portion, and a part of the suction-side guiding portion on the refrigerant suction side of the low-stage side compressor is located at a higher position in the vertical direction than a part of the suction-side guiding portion on the side of the bypass branch portion.

8 Claims, 6 Drawing Sheets

(51) Int. Cl.
*F25B 43/02* (2006.01)
*F25B 31/00* (2006.01)

(52) U.S. Cl.
CPC ... *F25B 2400/0401* (2013.01); *F25B 2400/13* (2013.01)

TWO-STAGE COMPRESSION REFRIGERATION CYCLE

CROSS REFERENCE TO RELATED APPLICATIONS

This application is a U.S. National Phase Application under 35 U.S.C. 371 of International Application No. PCT/JP2016/058601 filed on Mar. 17, 2016 and published in Japanese as WO 2017/038131 A1 on Mar. 9, 2017. This application is based on and claims the benefit of priority from Japanese Patent Application No. 2015-172160 filed on Sep. 1, 2015. The entire disclosures of all of the above applications are incorporated herein by reference.

FIELD OF THE INVENTION

The present disclosure relates to a two-stage compression refrigeration cycle that includes a low-stage side compressor and a high-stage side compressor to pressurize a refrigerant in plural stages.

BACKGROUND ART

Conventionally, a two-stage pressurizing refrigeration cycle is known to be capable of performing a two-stage compression operation and a single-stage compression operation (see, for example, Patent Document 1). In the two-stage compression operation, both of the two compressors are operated. In the single-stage compression operation, one of the two compressors is operated.

In the technique described in Patent Document 1, the refrigeration cycle can selectively perform the two-stage compression operation or the single-stage compression operation, thereby exhibiting its capacity corresponding to a load on the refrigeration cycle to improve the operation efficiency of the entire cycle.

RELATED ART DOCUMENT

Patent Document

Patent Document 1: Japanese Unexamined Patent Application Publication No. 2006-170488

SUMMARY OF INVENTION

The inventors have considered a structure in which the two compressors are connected together in series, and a bypass passage is added to allow a refrigerant to flow to the high-stage side compressor while bypassing the low-stage side compressor. Thus, when the operation of the low-stage side compressor stops, the refrigerant is guided to the high-stage side compressor via the bypass passage.

In some vapor compression refrigeration cycles, a lubricating oil is mixed into the refrigerant for the purpose of lubricating a compression mechanism and the like that are disposed in the compressor. In this type of refrigeration cycle, the lubricating oil is drawn into the compressor together with the refrigerant, thereby ensuring the reliability of the compressor.

However, when the refrigeration cycle is designed to have a path through which no refrigerant flows as appropriate, like the two-stage pressurizing refrigeration cycle considered by the inventors, the lubricating oil might accumulate in the path, making it difficult to draw the lubricating oil into the compressor.

For example, in the single-stage compression operation, the refrigerant does not flow to the low-stage side compressor. Consequently, the lubricating oil might occasionally accumulate in a suction path for the refrigerant in the low-stage side compressor. In this case, the amount of the lubricating oil supplied to the high-stage side compressor is reduced.

The present disclosure has been made in view of the foregoing matter, and it is an object of the present disclosure to provide a two-stage pressurizing refrigeration cycle which can suppress a reduction in the amount of a lubricating oil supplied to a compressor depending on the operating state of the cycle.

The present disclosure relates to a two-stage pressurizing refrigeration cycle

A two-stage pressurizing refrigeration cycle of the present disclosure includes: a low-stage side compressor that compresses and discharges a refrigerant in which a lubricating oil is mixed; a high-stage side compressor that compresses and discharges the refrigerant discharged from the low-stage side compressor; a low-stage side suction pipe connected to a refrigerant suction side of the low-stage side compressor; a low-stage side discharge pipe that connects a refrigerant discharge side of the low-stage side compressor to a refrigerant suction side of the high-stage side compressor; a high-stage side discharge pipe connected to the refrigerant discharge side of the high-stage side compressor; a bypass pipe branched from the low-stage side suction pipe and connected to the low-stage side discharge pipe, the bypass pipe being configured to guide the refrigerant to the high-stage side compressor while bypassing the low-stage side compressor when the low-stage side compressor stops; and a check valve provided in the bypass pipe, the check valve being configured to allow a flow of the refrigerant from the low-stage side suction pipe to the low-stage side discharge pipe, while blocking a flow of the refrigerant from the low-stage side discharge pipe to the low-stage side suction pipe.

According to an aspect of the present disclosure, in the two-stage pressurizing refrigeration cycle, a suction-side guiding portion is provided in a part of the low-stage side suction pipe that leads from a bypass branch portion, at which the bypass pipe is branched, to the refrigerant suction side of the low-stage side compressor. The suction-side guiding portion is configured to guide the lubricating oil from the refrigerant suction side of the low-stage side compressor to a side of the bypass branch portion. Further, the suction-side guiding portion is located at a position in a vertical direction that is equal to or higher than a position in the vertical direction of the bypass branch portion, and a part of the suction-side guiding portion on the refrigerant suction side of the low-stage side compressor is located at a higher position in the vertical direction than a part of the suction-side guiding portion on the side of the bypass branch portion.

Thus, when the low-stage side compressor stops, the lubricating oil accumulated in the part of the low-stage side suction pipe, which leads from the bypass branch portion to the refrigerant suction side of the low-stage side compressor, can be guided to the bypass branch portion due to its own weight. Then, the lubricating oil guided to the bypass branch portion flows toward the refrigerant suction side of the high-stage side compressor together with the refrigerant via the bypass passage. Consequently, the lubricating oil can be prevented from accumulating in the low-stage side suction pipe due to the stopping of the low-stage side compressor, thereby making it possible to suppress a reduction in the amount of the lubricating oil supplied to the high-stage side compressor.

According to another aspect of the present disclosure, in the two-stage pressurizing refrigeration cycle, the low-stage side suction pipe is provided with a bypass branch portion at which the bypass pipe is branched. Further, the bypass pipe is provided with a bypass-side guiding portion to guide the lubricating oil from a side of the check valve to a side of the bypass branch portion. Moreover, the bypass-side guiding portion is located at a position in a vertical direction that is equal to or higher than a position in the vertical direction of the bypass branch portion, and a part of the bypass-side guiding portion on the side of the check valve is located at a higher position in the vertical direction than a part of the bypass-side guiding portion on the side of the bypass branch portion.

Thus, when the low-stage side compressor operates, the lubricating oil accumulated in the bypass pipe can be guided to the bypass branch portion due to its own weight. Then, the lubricating oil guided to the bypass branch portion flows toward the refrigerant suction side of the low-stage side compressor together with the refrigerant. Thus, the lubricating oil can be prevented from accumulating in the bypass pipe when the low-stage side compressor operates, thereby making it possible to suppress a reduction in the amount of the lubricating oil supplied to the low-stage side compressor.

DESCRIPTION OF EMBODIMENTS

Figure 1:
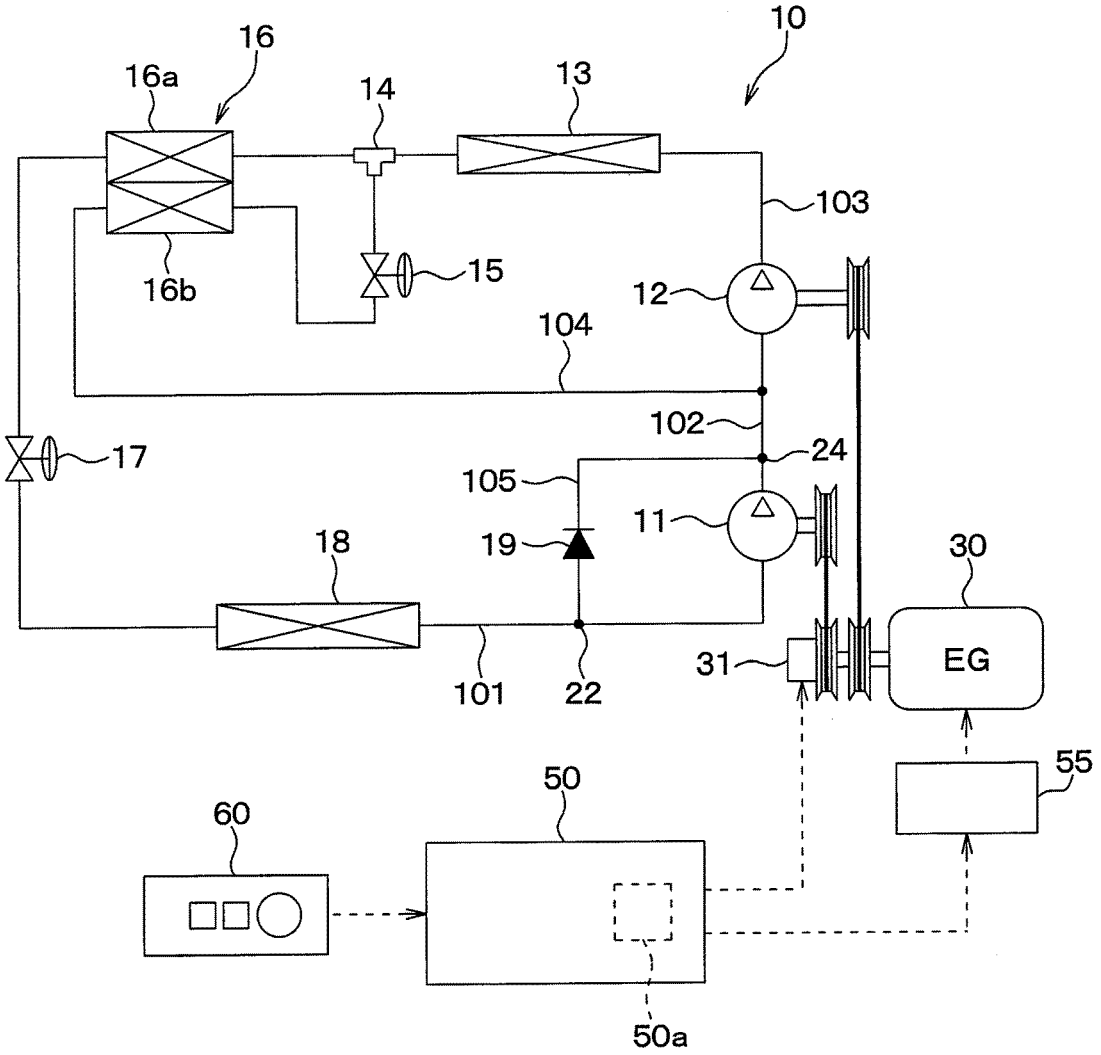
FIG. 1 is an entire configuration diagram of a two-stage pressurizing refrigeration cycle in a first embodiment.

Embodiments of the present disclosure will be described below with reference to the accompanying drawings. In the following respective embodiments, the same or equivalent parts as the matters explained in the previous embodiments are denoted by the same reference numerals, and the description thereof will be omitted in some cases.

When only a part of a component in each of the embodiments is explained, other parts of the component can be applied to components explained in the previous embodiment(s).

The following embodiments can be partially combined to each other, particularly as long as the combination does not cause any contradiction, unless otherwise specified.

(First Embodiment)

The present embodiment will be described with reference to FIGS. 1 and 4. FIG. 1 is an entire configuration diagram of a two-stage pressurizing refrigeration cycle 10 in a present embodiment. The two-stage pressurizing refrigeration cycle 10 in the present embodiment is used in a trailer with a refrigerator and serves to cool ventilation air to be blown into the inside of the refrigerator as a space to be cooled, to an ultralow temperature of approximately −30° C. to −10° C.

As illustrated in FIG. 1, the two-stage pressurizing refrigeration cycle 10 includes two compressors, namely, a low-stage side compressor 11 and a high-stage side compressor 12. Thus, the two-stage pressurizing refrigeration cycle 10 is capable of pressurizing a refrigerant circulating through the cycle in plural stages.

Specifically, the two-stage pressurizing refrigeration cycle 10 in the present embodiment is capable of performing a two-stage compression operation and a single-stage compression operation. In the two-stage compression operation, both the low-stage side compressor 11 and the high-stage side compressor 12 are operated. In the single-stage compression operation, the high-stage side compressor 12 out of the low-stage side compressor 11 and high-stage side compressor 12 is operated. As the refrigerant, a normal fluorocarbon refrigerant (for example, R404A) can be used. The refrigerant further has a refrigerant oil (i.e., oil) mixed therein as a lubricating oil to lubricate sliding parts in the low-stage side compressor 11 and the high-stage side compressor 12. Part of the oil circulates through the cycle together with the refrigerant.

The low-stage side compressor 11 includes a compression mechanism that compresses and discharges a low-pressure refrigerant into an intermediate-pressure refrigerant. The low-stage side compressor 11 in the present embodiment is configured of a fixed displacement compression mechanism with a discharge capacity of the refrigerant fixed. Examples of the compression mechanism of the low-stage side compressor 11 in use can include various types of compression mechanisms, such as a scroll compression mechanism, a vane compression mechanism, and a rolling piston compression mechanism.

A low-stage side suction pipe 101 is connected to a refrigerant suction side of the low-stage side compressor 11. The low-stage side suction pipe 101 is also connected to a side of a refrigerant outlet of an evaporator 18 to be described later. A low-stage side discharge pipe 102 is connected to a refrigerant discharge side of the low-stage side compressor 11.

The low-stage side discharge pipe 102 is connected to a refrigerant suction side of the high-stage side compressor 12. The high-stage side compressor 12 has a compression mechanism that compresses the refrigerant flowing through the low-stage side discharge pipe 102, into a high-pressure refrigerant to discharge the compressed refrigerant. The high-stage side compressor 12 in the present embodiment is configured as a fixed displacement compression mechanism, like the low-stage side compressor 11. A high-stage side discharge pipe 103 is connected to a refrigerant discharge side of the high-stage side compressor 12. The high-stage side discharge pipe 103 is also connected to a side of a refrigerant inlet of a heat radiator 13. The layout made when the respective compressors 11 and 12 are installed on the trailer will be described later.

Here, the low-stage side compressor 11 and the high-stage side compressor 12 in the present embodiment are rotatably driven by an internal combustion engine (for example, engine EG) 30 dedicated for the refrigerator mounted on the trailer. The internal combustion engine 30 is connected to both the low-stage side compressor 11 and the high-stage side compressor 12 via pulleys and belts such that its rotational driving force is transferred to the respective compressors 11 and 12. The internal combustion engine 30 is connected to a controller 50 via a driving device 55 and has its operation controlled in response to a control signal from the controller 50.

An electromagnetic clutch 31 is provided between the low-stage side compressor 11 and the internal combustion engine 30 in the present embodiment. The electromagnetic clutch 31 serves to turn on and off the transfer of the rotational driving force from the internal combustion engine 30 to the low-stage side compressor 11. The electromagnetic clutch 31 has its operation controlled in response to a control signal from the controller 50 to be described later.

The heat radiator 13 is a heat-dissipation heat exchanger that exchanges heat between the high-pressure refrigerant discharged from the high-stage side compressor 12 and air outside the refrigerator (i.e., outside air) blown by a cooling fan (not shown). Thus, the heat radiator 13 dissipates heat from the high-pressure refrigerant to cool the refrigerant. The two-stage pressurizing refrigeration cycle 10 in the present embodiment configures a subcritical refrigeration cycle in which a high-pressure side refrigerant pressure does not exceed the critical pressure of the refrigerant, using a fluorocarbon refrigerant as the refrigerant. Thus, the heat radiator 13 serves as a condenser that condenses the refrigerant.

A refrigerant outlet of the heat radiator 13 is connected to a branch portion 14 that branches the flow of the refrigerant flowing out of the heat radiator 13. The branch portion 14 has a three-way joint structure with three flow inlet/outlets formed therein. In the branch portion 14, one of these flow inlet/outlets serves as a refrigerant flow inlet, while two of them serve as refrigerant flow outlets. Such a branch portion 14 may be formed by joining pipes or by providing a plurality of refrigerant passages in a metal block or a resin block.

One refrigerant outlet of the branch portion 14 is connected to an inlet side of an intermediate-pressure expansion valve 15, while the other refrigerant outlet of the branch portion 14 is connected to an inlet side of a high-pressure refrigerant flow path 16*a* in an intermediate heat exchanger 16. The intermediate-pressure expansion valve 15 is a thermal expansion valve that decompresses and expands the high-pressure refrigerant, flowing out of the heat radiator 13, into the intermediate-pressure refrigerant.

More specifically, the intermediate-pressure expansion valve 15 adjusts its valve opening degree based on the temperature and pressure of the refrigerant at the outlet side of an intermediate-pressure refrigerant flow path 16*b* such that a superheat degree of the refrigerant at the outlet side of the intermediate-pressure refrigerant flow path 16*b* reaches a predetermined value previously set. The outlet side of the intermediate-pressure expansion valve 15 is connected to the inlet side of the intermediate-pressure refrigerant flow path 16*b*.

The intermediate heat exchanger 16 is a heat exchanger that exchanges heat between an intermediate-pressure refrigerant decompressed and expanded by the intermediate-pressure expansion valve 15 and circulating through the intermediate-pressure refrigerant flow path 16*b* and the other high-pressure refrigerant branched by the branch portion 14 and circulating through the high-pressure refrigerant flow path 16*a*. The refrigerant has its temperature decreased when being decompressed. Thus, in the intermediate heat exchanger 16, the intermediate-pressure refrigerant circulating through the intermediate-pressure refrigerant flow path 16*b* is heated, while the high-pressure refrigerant circulating through the high-pressure refrigerant flow path 16*a* is cooled.

The specific structure of the intermediate heat exchanger 16 adopts a double pipe heat exchanger structure in which an inner pipe forming the intermediate-pressure refrigerant flow path 16*b* is disposed inside an outer pipe forming the high-pressure refrigerant flow path 16*a*. It is obvious that the high-pressure refrigerant flow path 16*a* may be positioned as the inner pipe, and the intermediate-pressure refrigerant flow path 16*b* may be positioned as the outer pipe. Alternatively, the intermediate heat exchanger 16 may adopt the a structure in which refrigerant pipes forming the high-pressure refrigerant flow path 16*a* and intermediate-pressure refrigerant flow path 16*b* are bonded to each other to exchange heat therebetween.

The intermediate heat exchanger 16 shown in FIG. 1 adopts a parallel flow type heat exchanger in which the flow direction of the high-pressure refrigerant circulating through the high-pressure refrigerant flow path 16*a* is aligned with the flow direction of the intermediate-pressure refrigerant circulating through the intermediate-pressure refrigerant flow path 16*b*. It is obvious that a counterflow type heat exchanger may be adopted as the intermediate heat exchanger 16, in which the flow direction of the high-pressure refrigerant circulating through the high-pressure refrigerant flow path 16*a* is opposite to the flow direction of the intermediate-pressure refrigerant circulating through the intermediate-pressure refrigerant flow path 16*b*.

The outlet side of the intermediate-pressure refrigerant flow path 16*b* in the intermediate heat exchanger 16 is connected to the above-mentioned low-stage side discharge pipe 102 via an intermediate-pressure refrigerant pipe 104. Thus, the high-stage side compressor 12 in the present embodiment is capable of drawing a mixed refrigerant including the refrigerant flowing out of the intermediate-pressure refrigerant flow path 16*b* and the refrigerant discharged from the low-stage side compressor 11.

The outlet side of the high-pressure side refrigerant flow path 16*a* in the intermediate heat exchanger 16 is connected to the inlet side of a low-pressure expansion valve 17. The low-pressure expansion valve 17 is a thermal expansion valve that decompresses and expands the high-pressure refrigerant, flowing out of the heat radiator 13, into the low-pressure refrigerant. The low-pressure expansion valve 17 has substantially the same basic structure as that of the intermediate-pressure expansion valve 15.

More specifically, the low-pressure expansion valve 17 adjusts its valve opening degree based on the temperature and pressure of the refrigerant at the outlet side of the evaporator 18 such that a superheat degree of the refrigerant at the outlet side of the evaporator 18 reaches a predetermined value previously set.

The outlet side of the low-pressure expansion valve 17 is connected to the side of the refrigerant flow inlet of the evaporator 18. The evaporator 18 is a heat-absorption heat exchanger that exchanges heat between the low-pressure refrigerant decompressed and expanded by the low-pressure expansion valve 17 and the ventilation air blown by a blower fan (not shown) and circulating through the inside of the refrigerator, thereby evaporating the low-pressure refrigerant to exhibit the heat absorption effect. The low-stage side suction pipe 101 is connected to the refrigerant flow outlet of the evaporator 18.

In the low-stage side suction pipe 101, a bypass branch portion 22 is provided between the refrigerant flow outlet of the evaporator 18 and the refrigerant suction side of the low-stage side compressor 11. The bypass branch portion 22 has substantially the same basic structure as the above-mentioned branch portion 14. Specifically, the bypass branch portion 22 in the present embodiment has a T-shaped three-way joint structure with one refrigerant flow inlet and two refrigerant flow outlets formed therein.

A bypass pipe 105 is connected to the low-stage side suction pipe 101 via the bypass branch portion 22. The bypass pipe 105 is a refrigerant pipe that guides the refrigerant to the high-stage side compressor 12 while bypassing the low-stage side compressor 11, when the low-stage side compressor 11 stops. The expression "when the low-stage side compressor 11 stops" as used herein means a state in which the high-stage side compressor 12 is operating, but an electromagnetic clutch 31 is turned off to block the transfer of the rotational driving force from the internal combustion engine 30 to the low-stage side compressor 11.

Specifically, the bypass pipe 105 has one end thereof on the upstream side of the refrigerant flow connected to the bypass branch portion 22 and the other end thereof on the downstream side of the refrigerant flow connected to a merging portion 24 provided in the low-stage side discharge pipe 102.

The merging portion 24 shown in FIG. 1 is provided on the upstream side of the refrigerant flow with respect to a connection portion between the intermediate-pressure refrigerant pipe 104 and the low-stage side discharge pipe 102. It is obvious that the merging portion 24 may be provided on the downstream side of the refrigerant flow with respect to the connection portion between the intermediate-pressure refrigerant pipe 104 and the low-stage side discharge pipe 102.

A check valve 19 is provided in the bypass pipe 105. The check valve 19 is a valve member that allows for the flow of the refrigerant from the side of the low-stage side suction pipe 101 to the side of the low-stage side discharge pipe 102, while blocking the backward flow of the refrigerant from the side of the low-stage side discharge pipe 102 to the side of the low-stage side suction pipe 101. Examples of the check valve 19 in use can include a mechanical valve member that opens and closes by a pressure difference before and after the check valve, and an electric valve member that opens and closes by the presence or absence of the energization.

In the two-stage pressurizing refrigeration cycle 10 of the present embodiment, the check valve 19 prevents the refrigerant discharged from the low-stage side compressor 11 from flowing through the low-stage side discharge pipe 102, the bypass pipe 105, and the low-stage side suction pipe 101 in this order, when the low-stage side compressor 11 operates.

Next, a description will be given on the controller 50 that configures an electric control unit for the two-stage pressurizing refrigeration cycle 10 in the present embodiment. The controller 50 includes microcomputers that include a CPU and storage units, such as a ROM and a RAM for storing programs, data, etc., an output circuit for outputting a control signal or the like to the respective control target devices, and an input circuit into which a detection signal from each sensor is input.

The controller 50 has its output side connected to the above-mentioned electromagnetic clutch 31, the driving device 55 of the internal combustion engine 30, and the like, as the control target devices. The controller 50 controls the operations of these control target devices. The controller 50 in this embodiment incorporates therein control units for controlling the operations of the respective control target devices. In the controller 50, hardware and software adapted to control the operation of each control target device serve as a control unit for the corresponding control target device.

In the present embodiment, the hardware and software of the controller 50 for controlling the operation of the electromagnetic clutch 31 configure an operation switching control unit 50*a* that switches the operation of the two-stage pressurizing refrigeration cycle 10 between the two-stage compression operation and the single-stage compression operation.

The controller 50 has its input side connected to an outside-air temperature sensor, an in-refrigerator temperature sensor (although these sensors are not shown), and the like. The outside-air temperature sensor detects the temperature of the air outside the refrigerator (i.e., outside air) to exchange heat with the high-pressure refrigerant in the heat radiator 13. The in-refrigerator temperature sensor detects the temperature of ventilation air to exchange heat with the low-pressure refrigerant at the evaporator 18. Detection signals from the respective sensors are input to the controller 50.

An operation panel 60 is connected to the input side of the controller 50. The operation panel 60 is provided with an operation/stop switch, a temperature setting switch, and the like. The operation/stop switch outputs an operation request signal for requesting cooling of the refrigerator and a stop request signal for requesting stopping of the cooling. The temperature setting switch sets a target cooling temperature of the inside of the refrigerator. Operation signals of these respective switches are input to the controller 50.

Next, the operation of the two-stage pressurizing refrigeration cycle 10 with above-mentioned structure in the present embodiment will be described. As mentioned above, the two-stage pressurizing refrigeration cycle 10 in the present embodiment is capable of performing a two-stage compression operation in which both the low-stage side compressor 11 and the high-stage side compressor 12 are operated, as well as a single-stage compression operation in which the high-stage side compressor 12 out of the low-stage side compressor 11 and the high-stage side compressor 12 is operated.

The controller 50 in the present embodiment switches between the two-stage compression operation and the single-stage compression operation depending on the state of a load applied on the two-stage pressurizing refrigeration cycle 10. For instance, the controller 50 turns on the electromagnetic clutch 31 to perform the two-stage compression operation in a transient state, like the start-up of the refrigerator. In the transient state, a difference between the temperature inside the refrigerator and the preset temperature (i.e., target cooling temperature), which deviate from each other, exceeds a predetermined reference temperature difference. Further, the controller 50 turns off the electromagnetic clutch 31 to perform the single-stage compression operation in a steady state where a difference between a temperature inside the refrigerator and the preset temperature (i.e., target cooling temperature) is within the predetermined reference temperature difference.

In the two-stage pressurizing refrigeration cycle 10 during the two-stage compression operation, the high-stage side compressor 12 draws the mixed refrigerant including an intermediate-pressure refrigerant discharged from the low-stage side compressor 11 and an intermediate-pressure refrigerant flowing out of the intermediate-pressure refrigerant flow path 16*b* of the intermediate heat exchanger 16. Then, the high-stage side compressor 12 compresses and discharges the mixed refrigerant.

The high-temperature and high-pressure refrigerant discharged from the high-stage side compressor 12 flows into the heat radiator 13 and exchanges heat with the air outside the refrigerator blown from the cooling fan to thereby be cooled. The flow of the high-pressure refrigerant from the heat radiator 13 is branched by the branch portion 14. The high-pressure refrigerant flowing from the branch portion 14 into the intermediate-pressure expansion valve 15 is decompressed and expanded into an intermediate-pressure refrigerant.

At this time, a throttle opening degree of the intermediate-pressure expansion valve 15 is adjusted such that the superheat degree of the refrigerant at the outlet side of the intermediate-pressure refrigerant flow path 16*b* in the intermediate heat exchanger 16 is a predetermined value previously set. The intermediate-pressure refrigerant decompressed by the intermediate-pressure expansion valve 15 flows into the intermediate-pressure refrigerant flow path 16*b* in the intermediate heat exchanger 16. Then, the refrigerant exchanges heat with the high-pressure refrigerant that flows from the branch portion 14 into the high-pressure refrigerant flow path 16*a* of the intermediate heat exchanger 16, and thereby the refrigerant is heated and drawn into the high-stage side compressor 12.

Meanwhile, the high-pressure refrigerant flowing from the branch portion 14 into the high-pressure refrigerant flow path 16*a* in the intermediate heat exchanger 16 is cooled in the intermediate heat exchanger 16. The high-pressure refrigerant flowing from the high-pressure refrigerant flow path 16*a* flows into the low-pressure expansion valve 17 to be decompressed and expanded into a low-pressure refrigerant.

The low-pressure refrigerant decompressed by the low-pressure expansion valve 17 flows into the evaporator 18 and absorbs heat from the circulating ventilation air blown from the blower fan to evaporate itself. In this way, the ventilation air to be blown into the inside of the refrigerator as the space to be cooled is cooled. The refrigerant flowing out of the evaporator 18 is drawn into and compressed again by the low-stage side compressor 11.

Subsequently, in the two-stage pressurizing refrigeration cycle 10 during the single-stage compression operation, the electromagnetic clutch 31 is turned off, so that the low-stage side compressor 11 is in a stopped state. Thus, the high-stage side compressor 12 draws, compresses, and discharges the mixed refrigerant including the refrigerant having passed through the evaporator 18 via the bypass pipe 105 and the intermediate-pressure refrigerant flowing out of the intermediate-pressure refrigerant flow path 16*b* in the intermediate heat exchanger 16.

The high-temperature and high-pressure refrigerant discharged from the high-stage side compressor 12 flows into the heat radiator 13 and exchanges heat with the air outside the refrigerator blown by the cooling fan to thereby be cooled. The flow of the high-pressure refrigerant from the heat radiator 13 is branched by the branch portion 14. The high-pressure refrigerant flowing from the branch portion 14 into the intermediate-pressure expansion valve 15 is decompressed and expanded into an intermediate-pressure refrigerant.

The intermediate-pressure refrigerant decompressed by the intermediate-pressure expansion valve 15 flows into the intermediate-pressure refrigerant flow path 16*b* in the intermediate heat exchanger 16. The refrigerant exchanges heat with the high-pressure refrigerant flowing from the branch portion 14 into the high-pressure refrigerant flow path 16*a* of the intermediate heat exchanger 16, to be thereby heated and drawn into the high-stage side compressor 12.

Meanwhile, the high-pressure refrigerant flowing from the branch portion 14 into the high-pressure refrigerant flow path 16*a* of the intermediate heat exchanger 16 is cooled by the intermediate heat exchanger 16. The high-pressure refrigerant flowing out of the high-pressure refrigerant flow path 16*a* flows into the low-pressure expansion valve 17 to be decompressed and expanded into a low-pressure refrigerant.

The low-pressure refrigerant decompressed by the low-pressure expansion valve 17 flows into the evaporator 18 and absorbs heat from the circulating ventilation air blown from the blower fan to evaporate itself. In this way, the ventilation air to be blown into the inside of the refrigerator as the space to be cooled is cooled. The refrigerant flowing out of the evaporator 18 is drawn into and compressed again by the high-stage side compressor 12 via the bypass pipe 105.

Here, during the single-stage compression operation, the low-stage side compressor 11 is stopping. Thus, the refrigerant does not flow through a part of the low-stage side suction pipe 101 that leads from the bypass branch portion 22 to the refrigerant suction side of the low-stage side compressor 11. Meanwhile, during the two-stage compression operation, the low-stage side compressor 11 is operating. Thus, the refrigerant does not flow through the bypass pipe 105.

In this way, in the two-stage pressurizing refrigeration cycle 10 of the present embodiment, a path through which the refrigerant does not flow is formed in the cycle, depending on the presence or absence of the operation of the low-stage side compressor 11. If there is the path through which no refrigerant flows in the cycle, oil as the lubricating oil might accumulate in the path, thus decreasing the amount of the oil supplied to the respective compressors 11 and 12.

Figure 2:
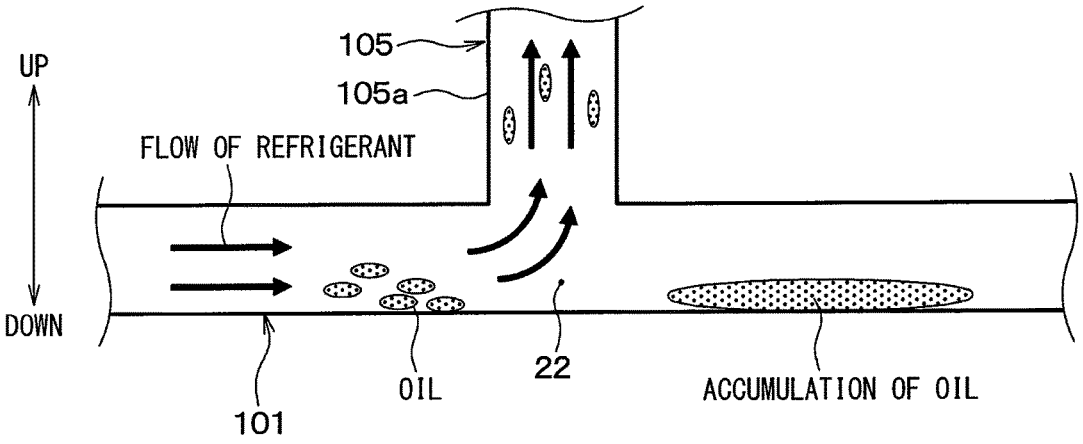
FIG. 2 is a schematic diagram showing the flows of a refrigerant and an oil near a bypass branch part in a single-stage compression operation of a two-stage pressurizing refrigeration cycle in Comparative Example 1.

For example, as illustrated in Comparative Example 1 of FIG. 2, in a case where the low-stage side suction pipe 101 is configured to extend horizontally, the flow of the refrigerant containing oil has its direction changed at the bypass branch portion 22 toward the side of the bypass pipe 105 when the low-stage side compressor 11 stops. At this time, strong force of inertia acts on the oil, which has a larger density than the refrigerant. Consequently, the oil might flow not only to the side of the bypass pipe 105, but also to a part of the low-stage side suction pipe 101 on the downstream side with respect to the bypass branch portion 22 and further could accumulate in the part.

To cope with such a matter, in the present embodiment, the layout around the respective compressors 11 and 12 is modified. Now, the layout around the respective compressors 11 and 12 in the present embodiment will be described with reference to FIG. 3.

Figure 3:
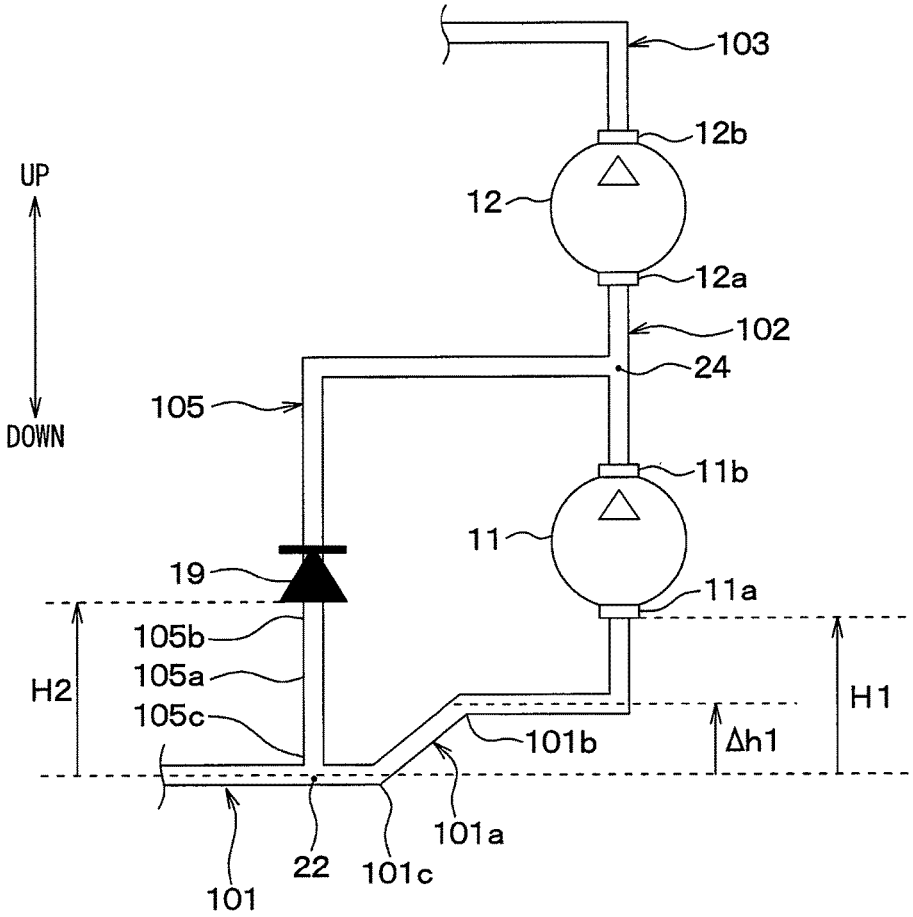
FIG. 3 is a schematic diagram showing a layout made when respective compressors are installed in the two-stage pressurizing refrigeration cycle of the first embodiment.

FIG. 3 is a schematic diagram showing the layout made when the respective compressors 11 and 12 are installed on the trailer. The arrows indicative of the upward direction and the downward direction as illustrated in FIG. 3 totally indicate the vertical direction when the compressors are installed on the trailer. For convenience of explanation, FIG. 3 omits the illustration of the intermediate-pressure refrigerant pipe 104. The term vertical direction as used herein means the direction of gravity, i.e., the direction perpendicular to the horizontal plane.

In the present embodiment, the refrigeration cycle is configured to make the collection of oil in the bypass branch portion 22 easier by focusing on the flow of the refrigerant to the bypass branch portion 22 in the low-stage side suction pipe 101 in both the two-stage compression operation and the single-stage compression operation.

As illustrated in FIG. 3, the low-stage side suction pipe 101 in the present embodiment is provided with a suction-side guiding portion 101*a* in a part leading from the bypass branch portion 22 to a refrigerant suction part 11*a* in the low-stage side compressor 11. The suction-side guiding portion 101*a* is a part that guides the oil from the side of the refrigerant suction part 11*a* in the low-stage side compressor 11 to the side of the bypass branch portion 22 when the low-stage side compressor 11 stops.

The suction-side guiding portion 101*a* is set to be located at the position in the up-down direction (i.e., the vertical direction) that is equal to or higher than the position in the up-down direction of the bypass branch portion 22. Thus, the oil present at the side of the bypass branch portion 22 is less likely to flow to the side of the refrigerant suction part 11*a* in the low-stage side compressor 11 due to its own weight.

Further, the suction-side guiding portion 101*a* is set such that a part 101*b* on the side of the refrigerant suction part 11*a* in the low-stage side compressor 11 is located at the higher position in the up-down direction than a part 101*c* on the side of the bypass branch portion 22. The suction-side guiding portion 101*a* in the present embodiment is inclined relative to the up-down direction such that the part 101*b* on the side of the refrigerant suction part 11*a* in the low-stage side compressor 11 is located at the higher position in the up-down direction than the position of the part 101*c* on the side of the bypass branch portion 22 only by $\Delta h1$.

The suction-side guiding portion 101*a* in the present embodiment is configured of a part of the low-stage side suction pipe 101 that is bent upward and which leads from the bypass branch portion 22 to the refrigerant suction part 11*a* in the low-stage side compressor 11. The suction-side guiding portion 101*a* may be configured of a single pipe or a plurality of pipes coupled together.

In the low-stage side suction pipe 101 in the present embodiment, the bypass branch portion 22 is disposed at a lower position than the refrigerant suction part 11*a* in the low-stage side compressor 11. Specifically, the low-stage side compressor 11 in the present embodiment is disposed at a higher position in the up-down direction than the bypass branch portion 22 only by H1.

A bypass-side guiding portion 105*a* is provided in a part of the bypass pipe 105 of the present embodiment that leads from the bypass branch portion 22 to the check valve 19. The bypass-side guiding portion 105*a* is a part that guides the oil from the side of the check valve 19 to the side of the bypass branch portion 22 when the low-stage side compressor 11 operates.

The bypass-side guiding portion 105*a* is set to be located at the position in the up-down direction (i.e., the vertical direction) that is equal to or higher than the position in the up-down direction of the bypass branch portion 22. Thus, the oil present at the side of the bypass branch portion 22 is less likely to flow to the side of the bypass pipe 105 due to its own weight.

Further, the bypass-side guiding portion 105*a* is set such that a part 105*b* on the side of the check valve 19 is located at the higher position in the up-down direction than a part 105*c* on the side of the bypass branch portion 22. The bypass-side guiding portion 105*a* in the present embodiment extends in the up-down direction such that the part 105*b* on the side of the check valve 19 is located at the higher position in the up-down direction than the part 105*c* on the side of the bypass branch portion 22.

The bypass-side guiding portion 105*a* in the present embodiment is configured of a part of the bypass pipe 105 that leads from the bypass branch portion 22 to the check valve 19. The bypass-side guiding portion 105*a* may be configured of a single pipe or a plurality of pipes coupled together.

The bypass branch portion 22 in the present embodiment is disposed at a lower position than the check valve 19 in the up-down direction. Specifically, the check valve 19 in the present embodiment is disposed at a higher position in the up-down direction than the bypass branch portion 22 only by H2. Although FIG. 3 illustrates that H2 is larger than H1, the magnitude relationship between H1 and H2 may be reversed, or otherwise H1 may be equal to H2.

In the two-stage pressurizing refrigeration cycle 10 of the present embodiment, a refrigerant discharge part 11*b* of the low-stage side compressor 11 is connected to a refrigerant suction part 12*a* of the high-stage side compressor 12 via the low-stage side discharge pipe 102 extending in the up-down direction. In the present embodiment, the high-stage side discharge pipe 103 is connected to a refrigerant discharge part 12*b* of the high-stage side compressor 12, which is disposed above the low-stage side compressor 11.

The two-stage pressurizing refrigeration cycle 10 in the present embodiment, mentioned above, is capable of switching between both the two-stage compression operation and the single-stage compression operation, thereby making it possible to effectively perform these operations depending on the state of a load applied on the cycle.

In addition, in the present embodiment, the suction-side guiding portion 101*a* is provided in the part of the low-stage side suction pipe 101 that leads from the bypass branch portion 22 to the side of the refrigerant suction part 11*a* in the low-stage side compressor 11.

Figure 4:
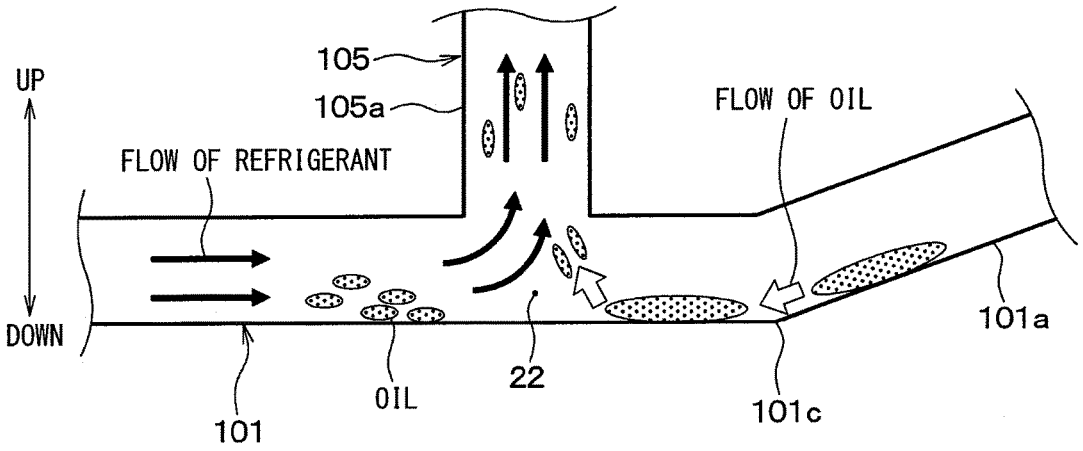
FIG. 4 is a schematic diagram showing the flows of a refrigerant and an oil near a bypass branch part in a single-stage compression operation of the two-stage pressurizing refrigeration cycle in the first embodiment.

Thus, as illustrated in FIG. 4, when the low-stage side compressor 11 stops, the oil accumulated in the part of the low-stage side suction pipe 101, which leads from the bypass branch portion 22 to the side of the refrigerant suction part 11*a* in the low-stage side compressor 11, can be guided to the side of the bypass branch portion 22 due to its own weight. Then, the oil guided to the bypass branch portion 22 flows toward the side of the refrigerant suction part 12*a* in the high-stage side compressor 12 together with the refrigerant via the bypass pipe 105.

Therefore, in the present embodiment with such a simple configuration, oil can be prevented from accumulating in the low-stage side suction pipe 101 due to the stopping of the low-stage side compressor 11, thereby making it possible to suppress a reduction in the amount of oil supplied to the high-stage side compressor 12.

In the present embodiment, the low-stage side compressor 11 is disposed at the higher position in the up-down direction than the bypass branch portion 22. With this configuration, the oil accumulated in the low-stage side compressor 11 is more likely to flow to the side of the bypass branch portion 22 due to its own weight. Thus, the oil can be prevented from accumulating in the low-stage side suction pipe 101 due to the stopping of the low-stage side compressor 11, thereby making it possible to suppress a reduction in the amount of lubricating oil supplied to the high-stage side compressor 12.

Furthermore, in the present embodiment, the bypass-side guiding portion 105*a* is provided in the part of the bypass pipe 105 that leads from the bypass branch portion 22 to the side of the check valve 19. With this configuration, when the low-stage side compressor 11 operates, the oil accumulated in the bypass pipe 105 can be guided to the side of the bypass branch portion 22 due to its own weight. Then, the oil guided to the bypass branch portion 22 flows toward the side of the refrigerant suction part 11*a* in the low-stage side compressor 11 together with the refrigerant.

Therefore, in the present embodiment with such a simple configuration, oil can be prevented from accumulating in the bypass pipe 105 due to the operation of the low-stage side compressor 11, thereby making it possible to suppress a reduction in the amount of oil supplied to the low-stage side compressor 11.

In the present embodiment, the check valve 19 is disposed at the higher position in the up-down direction than the bypass branch portion 22. With this configuration, the oil accumulated in the bypass pipe 105 is more likely to flow to the side of the bypass branch portion 22 due to its own weight. Thus, the oil can be prevented from accumulating in the bypass pipe 105 due to the operation of the low-stage side compressor 11, thereby making it possible to suppress a reduction in the amount of the oil supplied to a low-stage side compressor 111.

(Modification of First Embodiment)

Figure 5:
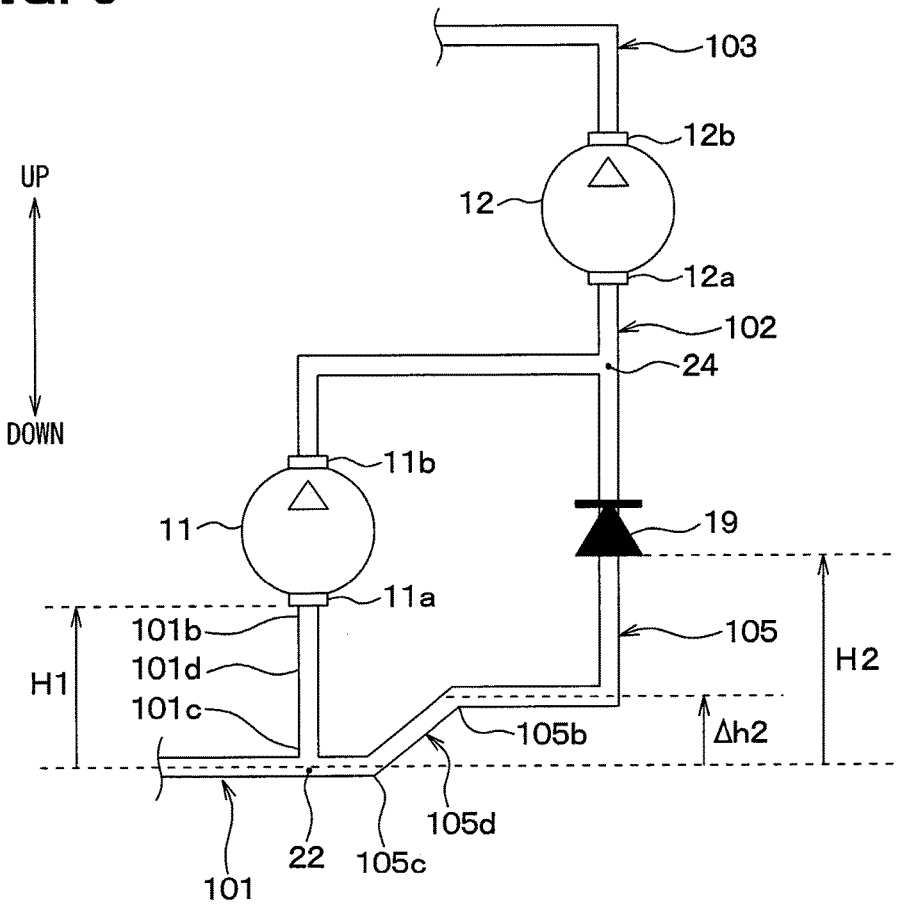
FIG. 5 is a schematic diagram showing a layout made when respective compressors are installed in the two-stage pressurizing refrigeration cycle in a modification of the first embodiment.

In the description of the above-mentioned first embodiment, the suction-side guiding portion 101*a* is inclined relative to the up-down direction, and the bypass-side guiding portion 105*a* extends along the up-down direction by way of example. However, the suction-side guiding portion 101*a* and the bypass-side guiding portion 105*a* are not limited thereto. For example, as shown in FIG. 5, a suction-side guiding portion 101*d* may extend along the up-down direction, and a bypass-side guiding portion 105*d* may be inclined relative to the up-down direction.

Even such a configuration can also achieve the same effects as those in the first embodiment. The configuration in which the suction-side guiding portion 101*d* extends along the up-down direction and the bypass-side guiding portion 105*d* is inclined relative to the up-down direction can also be applied to the following embodiments.

(Second Embodiment)

Next, a second embodiment will be described with reference to FIGS. 6 to 8. The present embodiment differs from the first embodiment in that an oil return pipe 20 and an oil separator 21 are added.

Figure 6:
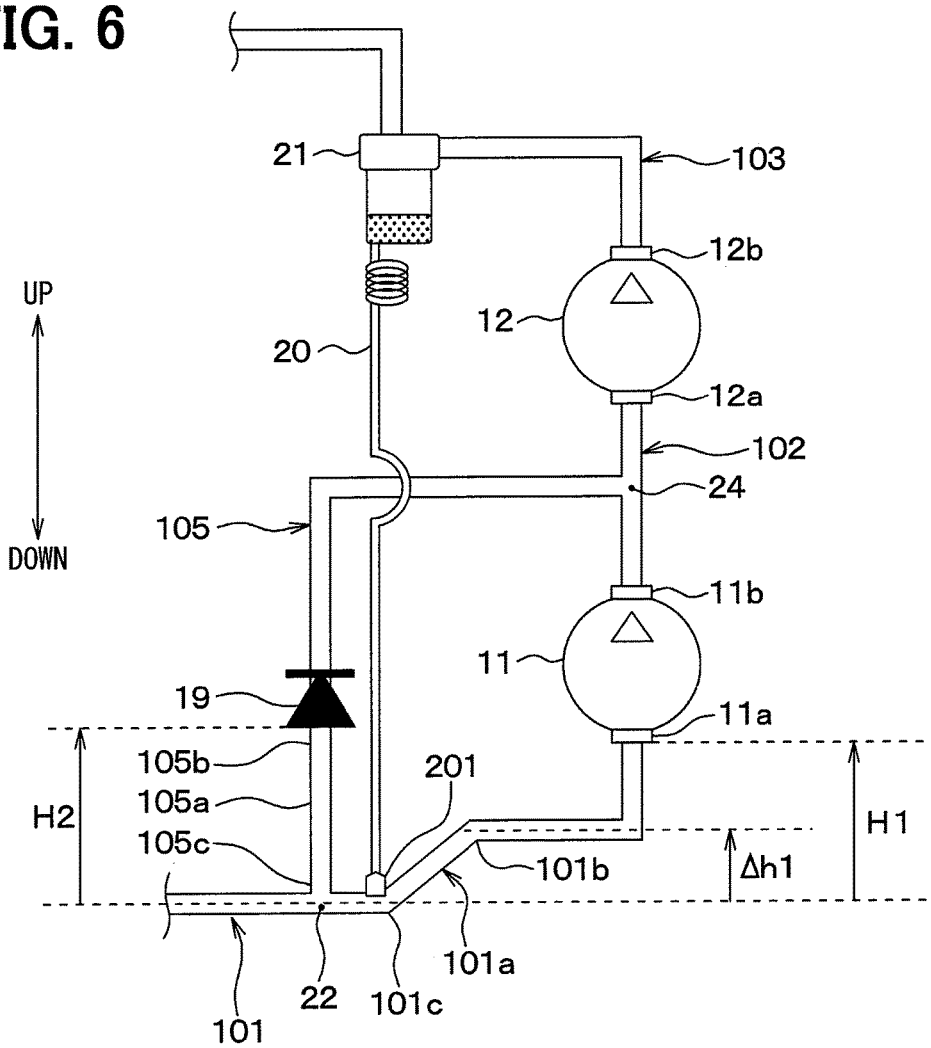
FIG. 6 is a schematic diagram showing a layout made when respective compressors are installed in the two-stage pressurizing refrigeration cycle of a second embodiment.

As shown in FIG. 6, the two-stage pressurizing refrigeration cycle 10 in the present embodiment is provided with the oil separator 21 in the high-stage side discharge pipe 103. The oil separator 21 is a device that separates oil from the refrigerant containing the oil and discharged from the high-stage side compressor 12.

The high-stage side discharge pipe 103 in the present embodiment is connected to the oil return pipe 20 for returning the oil separated by the oil separator 21 to the low-stage side suction pipe 101. The oil return pipe 20 has its one end connected to the high-stage side discharge pipe 103 via the oil separator 21 and its other end connected to the low-stage side suction pipe 101.

Thus, in the two-stage pressurizing refrigeration cycle 10, the circulation path for the oil is configured as a circulation path where oil is not cooled by any heat exchanger, such as the evaporator 18. Thus, the oil can be prevented from accumulating in the heat exchanger, such as the evaporator 18.

The oil passing through the high-stage side discharge pipe 103 has a high temperature and thereby a low viscosity. Thus, the oil flowing through the high-stage side discharge pipe 103 is returned to the low-stage side suction pipe 101, thereby making it possible to reduce the friction loss in the respective compressors 11 and 12.

Figure 7:
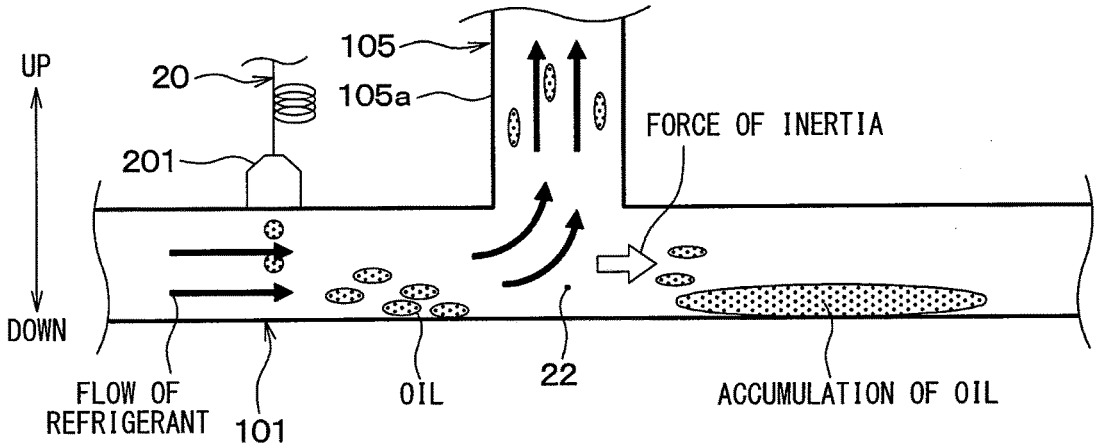
FIG. 7 is a schematic diagram showing the flows of a refrigerant and an oil near a bypass branch part in a single-stage compression operation of a two-stage pressurizing refrigeration cycle in Comparative Example 2.
Figure 8:
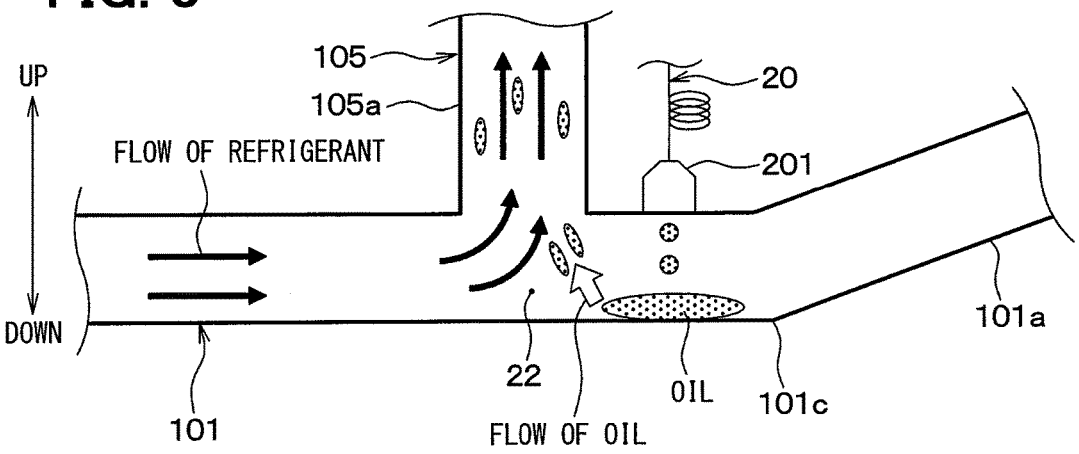
FIG. 8 is a schematic diagram showing the flows of a refrigerant and an oil near a bypass branch part in a single-stage compression operation of the two-stage pressurizing refrigeration cycle in the second embodiment.

As illustrated in Comparative Example 2 of FIG. 7, a connection portion 201 between the low-stage side suction pipe 101 and the oil return pipe 20 is proposed to be provided in a part of the low-stage side suction pipe 101 on the upstream side with respect to the bypass branch portion 22.

In the configuration illustrated in FIG. 7, when the low-stage side compressor 11 stops, the oil which has a larger density than the refrigerant is more likely to flow to the refrigerant suction side of the low-stage side compressor 11 due to force of inertia acting on the oil. It is undesirable that such a flow would cause the oil to accumulate in the low-stage side suction pipe 101 while the low-stage side compressor 11 is stopping.

In the present embodiment, as shown in FIG. 6, the connection portion 201 with the oil return pipe 20 in the low-stage side suction pipe 101 is provided in the part of the low-stage side suction pipe 101 that leads from the bypass branch portion 22 to the side of the refrigerant suction part 11*a* in the low-stage side compressor 11.

More specifically, in the present embodiment, the connection portion 201 is provided on the upstream side of the refrigerant flow with respect to the suction-side guiding portion 101*a* in the part of the low-stage side suction pipe 101 that leads from the bypass branch portion 22 to the side of the refrigerant suction part 11*a* in the low-stage side compressor 11.

The structures of other components in the present embodiment are the same as those in the first embodiment. The configuration of the present embodiment can achieve the following characteristic effects, in addition to the functions and effects achieved by the configuration of the first embodiment. That is, in the present embodiment, the connection portion 201 with the oil return pipe 20 in the low-stage side suction pipe 101 is provided in the part that leads from the bypass branch portion 22 to the side of the refrigerant suction part 11*a* in the low-stage side compressor 11. Thus, when the low-stage side compressor 11 stops, as illustrated in FIG. 8, no force of inertia acts on the oil returning to the low-stage side suction pipe 101 via the oil return pipe 20, so that the oil can be prevented from flowing to the refrigerant suction side of the low-stage side compressor 11.

Like the present embodiment, the configuration in which the oil is guided to the bypass branch portion 22 due to its own weight causes the oil to dissipate the heat while flowing up to the bypass branch portion 22, thereby making it possible to suppress the unnecessary heat exchange between the refrigerant and the oil in the bypass branch portion 22. In this way, the refrigerant is maintained at a low temperature. Thus, when the low-stage side compressor 11 stops, the entropy is decreased at the refrigerant suction side of the high-stage side compressor 12. Consequently, an increase in the power at the high-stage side compressor 12 can be suppressed to improve the operation efficiency of the two-stage pressurizing refrigeration cycle 10.

(Modification of Second Embodiment)

Figure 9:
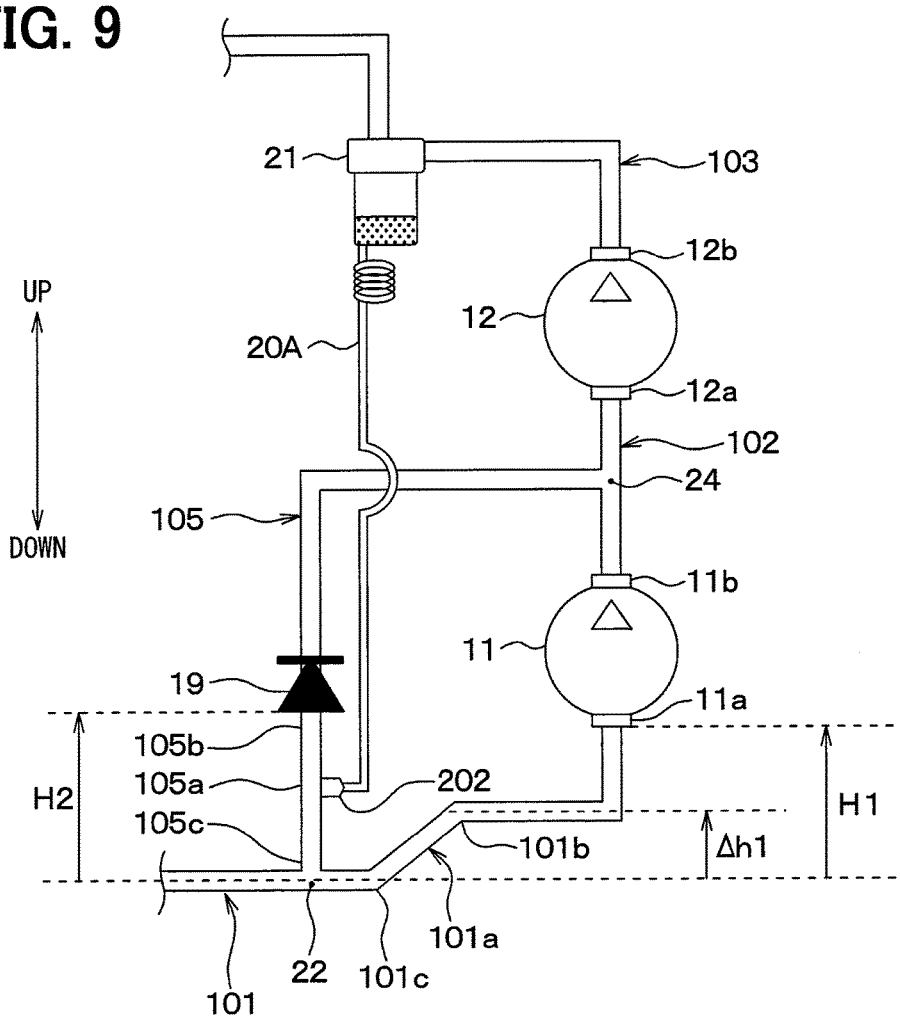
FIG. 9 is a schematic diagram showing a layout made when respective compressors are installed in the two-stage pressurizing refrigeration cycle in a modification of the second embodiment.

In the description of the above-mentioned second embodiment, the oil return pipe 20 is connected to the low-stage side suction pipe 101 by way of example. However, the oil return pipe 20 is not limited thereto. For example, as illustrated in FIG. 9, an oil return pipe 20A may be connected to the bypass pipe 105. Specifically, a connection portion 202 with the bypass pipe 105 in the oil return pipe 20 may be provided in the part that leads from the bypass branch portion 22 to the check valve 19.

In this way, the oil return pipe 20 is connected to the bypass pipe 105 on which no force of inertia acts while the low-stage side compressor 11 is operating. Thus, the oil can be prevented from flowing to the side of the bypass pipe 105 while the low-stage side compressor 11 is operating.

Like the present embodiment, the configuration in which the oil is guided to the bypass branch portion 22 due to its own weight causes the oil to dissipate its heat while flowing up to the bypass branch portion 22. Thus, according to the configuration in the present embodiment, like the second embodiment, the unnecessary heat exchange between the refrigerant and the oil in the bypass branch portion 22 can be suppressed. Consequently, the entropy on the refrigerant suction side is suppressed when the low-stage side compressor 11 operates, thereby making it possible to improve the operation efficiency of the two-stage pressurizing refrigeration cycle 10.

(Third Embodiment)

Figure 10:
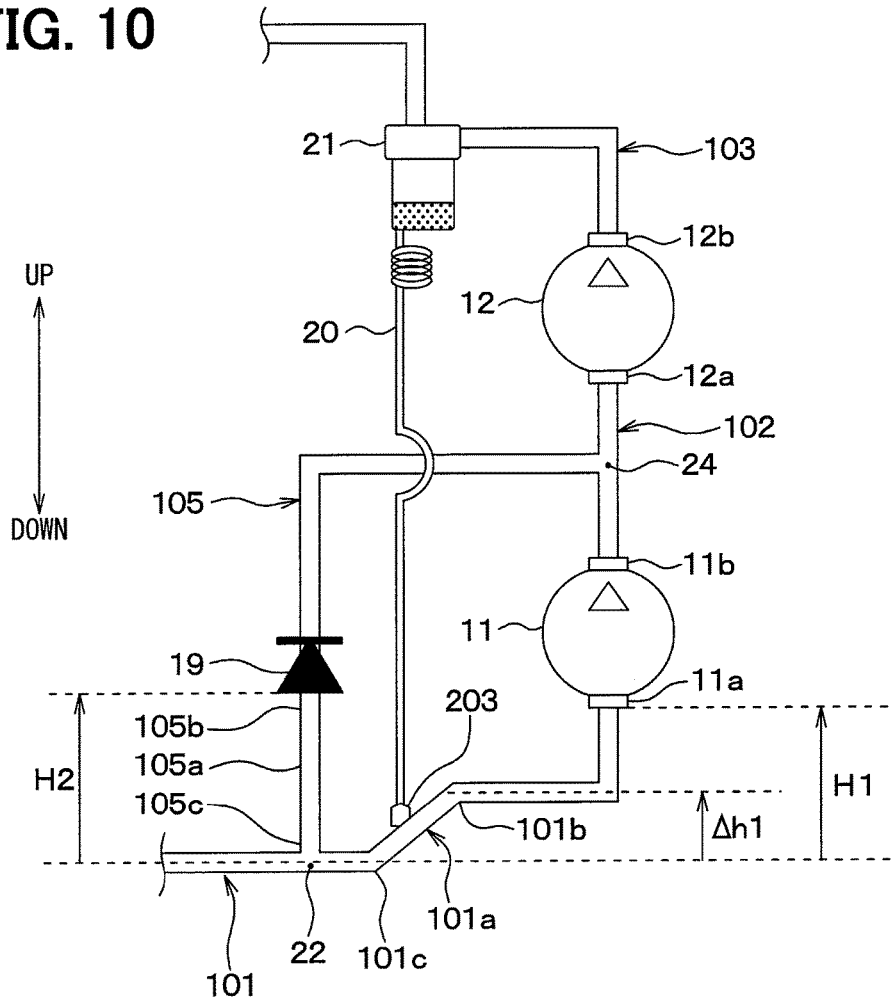
FIG. 10 is a schematic diagram showing a layout made when respective compressors are installed in the two-stage pressurizing refrigeration cycle of a third embodiment.
Figure 11:
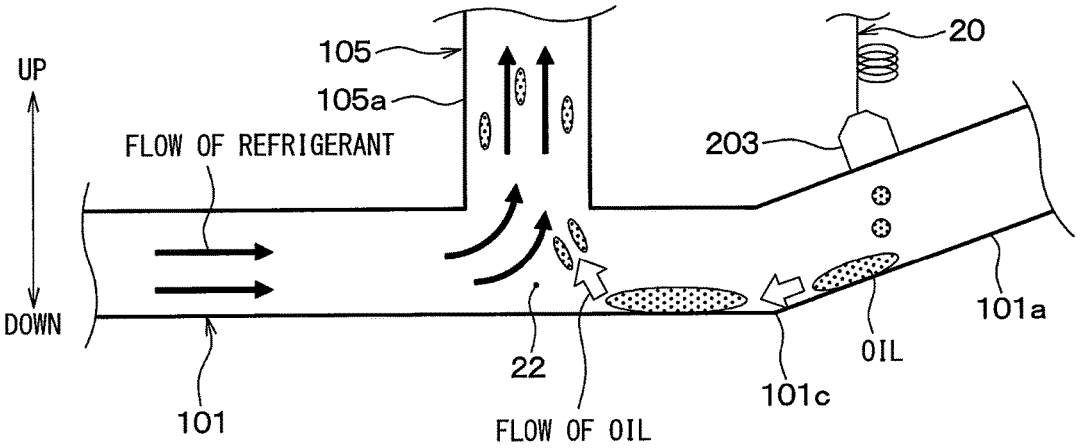
FIG. 11 is a schematic diagram showing the flows of a refrigerant and an oil near a bypass branch part in a single-stage compression operation of the two-stage pressurizing refrigeration cycle in the third embodiment.

Next, a third embodiment will be described with reference to FIGS. 10 and 11. As illustrated in FIG. 10, in the present embodiment, a connection portion 203 for connecting between the oil return pipe 20 and the low-stage side suction pipe 101 is provided in the suction-side guiding portion 101*a*.

The structures of other components in this embodiment are the same as those in the second embodiment. The configuration in the present embodiment can achieve the following characteristic effects, in addition to the functions and effects achieved by the configuration of the second embodiment. That is, in the present embodiment, the connection portion 203 for connecting between the oil return pipe 20 and the low-stage side suction pipe 101 is provided in the suction-side guiding portion 101*a*. With this configuration, as illustrated in FIG. 11, the oil returning from the oil return pipe 20 to the low-stage side suction pipe 101 flows toward the side of the bypass branch portion 22 due to its gravity weight along the suction-side guiding portion 101*a*, when the low-stage side compressor 11 stops. Thus, the oil can be prevented from accumulating in the low-stage side suction pipe 101 due to the stopping of the low-stage side compressor 11, thereby making it possible to suppress a reduction in the amount of the oil supplied to the high-stage side compressor 12.

(Other Embodiments)

Although the embodiments of the present disclosure have been described above, the present disclosure is not limited to the above-mentioned embodiments, and various modifications and changes can be made thereto. For example, modifications and changes can be made as follows.

(1) The above-mentioned respective embodiments have described the cycle configuration in which the branch portion 14 is provided on the downstream side of the heat radiator 13, and part of the refrigerant branched at the branch portion 14 is returned to the refrigerant suction side of the high-stage side compressor 12 via the intermediate-pressure expansion valve 15 and the intermediate heat exchanger 16. However, the cycle configuration is not limited thereto. For example, a cycle configuration may be one in which the branch portion 14, the intermediate-pressure expansion valve 15, and the intermediate heat exchanger 16 are abolished, and the intermediate-pressure refrigerant does not return to the refrigerant suction side of the high-stage side compressor 12.

(2) As mentioned in the above respective embodiments, it is desirable that the suction-side guiding portion 101*a* is provided in the low-stage side suction pipe 101, and that the bypass-side guiding portion 105*a* is provided in the bypass pipe 105. However, the guiding portions are not limited thereto. For example, the suction-side guiding portion 101*a* may be provided in the low-stage side suction pipe 101, but the bypass-side guiding portion 105*a* in the bypass pipe 105 may be abolished. Alternatively, the bypass-side guiding portion 105*a* may be provided in the bypass pipe 105, and the suction-side guiding portion 101*a* in the low-stage side suction pipe 101 may be abolished.

(3) As mentioned in the above respective embodiments, it is desirable that the low-stage side compressor 11 is disposed above the bypass branch portion 22, but is not limited thereto. The configuration in which the suction-side guiding portion 101*a* is provided in the low-stage side suction pipe 101 can prevent oil from accumulating in the low-stage side suction pipe 101. Thus, the low-stage side compressor 11 may be disposed at a lower position than the bypass branch portion 22.

(4) As mentioned in the above respective embodiments, it is desirable that the check valve 19 is disposed above the bypass branch portion 22, but is not limited thereto. The configuration in which the bypass-side guiding portion 105*a* is provided in the bypass pipe 105 can prevent oil from accumulating in the bypass pipe 105. Thus, the check valve 19 may be disposed at a lower position than the bypass branch portion 22.

(5) Although the above-mentioned embodiments have described an example in which the thermal expansion valve is adopted as the intermediate-pressure expansion valve 15 and the low-pressure expansion valve 17, an electric expansion valve may be adopted as the intermediate-pressure expansion valve 15 and the low-pressure expansion valve 17.

(6) The above-mentioned respective embodiments have described an example in which the two-stage pressurizing refrigeration cycle 10 is applied to a trailer with a freezer, but is not limited thereto. For example, the two-stage pressurizing refrigeration cycle 10 may be applied to an air conditioner, a refrigerator, or the like. The two-stage pressurizing refrigeration cycle 10 may be applied not only to a mobile body, such as a trailer, but also a stationary refrigerator or air conditioner, etc.

(7) The above-mentioned respective embodiments have described an example in which both the low-stage side compressor 11 and the high-stage side compressor 12 are driven by the internal combustion engine 30, but are not limited thereto. For example, both the low-stage side compressor 11 and the high-stage side compressor 12 may be driven by an electric motor. In this case, switching only needs to be performed between the two-stage compression operation and the single-stage compression operation by turning on/off of the electric motor for driving the low-stage side compressor 11.

(8) It is obvious that in the above-mentioned embodiments, elements configuring the embodiments are not necessarily essential particularly unless otherwise specified as being essential and except when clearly considered to be essential in principle.

(9) When referring to a specific number about a component in the above-mentioned embodiments, including the number, a numerical value, an amount, a range, and the like, the component should not be limited to the specific number particularly unless otherwise specified as being essential and except when obviously limited to the specific number in principle.

(10) When referring to the shape of a component, the positional relationship between components, and the like in the above-mentioned embodiments, the component should not be limited to the shape, positional relationship, or the like unless otherwise specified and except when limited to the specific shape, positional relationship, or the like in principle.

What is claimed is:

1. A two-stage pressurizing refrigeration cycle, comprising:

a low-stage side compressor that compresses and discharges a refrigerant in which a lubricating oil is mixed;

a high-stage side compressor that compresses and discharges the refrigerant discharged from the low-stage side compressor;

a low-stage side suction pipe connected to a refrigerant suction side of the low-stage side compressor;

a low-stage side discharge pipe that connects a refrigerant discharge side of the low-stage side compressor to a refrigerant suction side of the high-stage side compressor;

a high-stage side discharge pipe connected to the refrigerant discharge side of the high-stage side compressor;

a bypass pipe branched from the low-stage side suction pipe and connected to the low-stage side discharge pipe, the bypass pipe being configured to guide the refrigerant to the high-stage side compressor while bypassing the low-stage side compressor when the low-stage side compressor stops; and a check valve provided in the bypass pipe, the check valve being configured to allow a flow of the refrigerant from the low-stage side suction pipe to the low-stage side discharge pipe, while blocking a flow of the refrigerant from the low-stage side discharge pipe to the low-stage side suction pipe, wherein a suction-side guiding portion is provided in a part of the low-stage side suction pipe that leads from a bypass branch portion, at which the bypass pipe is branched, to the refrigerant suction side of the low-stage side compressor, the suction-side guiding portion being configured to guide the lubricating oil from the refrigerant suction side of the low-stage side compressor to a side of the bypass branch portion, and the suction-side guiding portion is located at a position in a vertical direction that is equal to or higher than a position in the vertical direction of the bypass branch portion, and a part of the suction-side guiding portion on the refrigerant suction side of the low-stage side compressor is located at a higher position in the vertical direction than a part of the suction-side guiding portion on the side of the bypass branch portion.

2. The two-stage pressurizing refrigeration cycle according to claim 1, wherein the low-stage side compressor is disposed at a higher position in the vertical direction than the bypass branch portion.

3. The two-stage pressurizing refrigeration cycle according to claim 1, wherein the bypass pipe is provided with a bypass-side guiding portion that guides the lubricating oil from a side of the check valve to the side of the bypass branch portion, and the bypass-side guiding portion is located at a position in the vertical direction that is equal to or higher than a position in the vertical direction of the bypass branch portion, while a part of the bypass-side guiding portion on the side of the check valve is located at a higher position in the vertical direction than a part of the bypass-side guiding portion on the side of the bypass branch portion.

4. The two-stage pressurizing refrigeration cycle according to claim 3, wherein the check valve is disposed at a higher position in the vertical direction than the bypass branch portion.

5. The two-stage pressurizing refrigeration cycle according to claim 1, wherein the high-stage side discharge pipe is provided with an oil separator to separate the lubricating oil from the refrigerant containing the mixed lubricating oil, and is connected to an oil return pipe that guides the lubricating oil separated by the oil separator to the low-stage side suction pipe, and the oil return pipe is connected to the low-stage side suction pipe at a connection portion that is positioned in the low-stage side suction pipe from the bypass branch portion to the refrigerant suction side of the low-stage side compressor.

6. The two-stage pressurizing refrigeration cycle according to claim 1, wherein the high-stage side discharge pipe is provided with an oil separator to separate the lubricating oil from the refrigerant containing the mixed lubricating oil, and is connected to an oil return pipe to guide the lubricating oil separated by the oil separator to the bypass pipe, and the oil return pipe is connected to the bypass pipe at a connection portion that is positioned in the bypass pipe from the bypass branch portion to the check valve.

7. A two-stage pressurizing refrigeration cycle, comprising:

a low-stage side compressor that compresses and discharges a refrigerant in which a lubricating oil is mixed;

a high-stage side compressor that compresses and discharges the refrigerant discharged from the low-stage side compressor;

a low-stage side suction pipe connected to a refrigerant suction side of the low-stage side compressor;

a low-stage side discharge pipe that connects a refrigerant discharge side of the low-stage side compressor to a refrigerant suction side of the high-stage side compressor;

a high-stage side discharge pipe connected to the refrigerant discharge side of the high-stage side compressor;

a bypass pipe branched from the low-stage side suction pipe and connected to the low-stage side discharge pipe, the bypass pipe being configured to guide the refrigerant to the high-stage side compressor while bypassing the low-stage side compressor when the low-stage side compressor stops; and a check valve provided in the bypass pipe, the check valve being configured to allow a flow of the refrigerant from the low-stage side suction pipe to the low-stage side discharge pipe, while blocking a flow of the refrigerant from the low-stage side discharge pipe to the low-stage side suction pipe, wherein the low-stage side suction pipe is provided with a bypass branch portion at which the bypass pipe is branched from the low-stage side suction pipe, the bypass pipe is provided with a bypass-side guiding portion to guide the lubricating oil from a side of the check valve to a side of the bypass branch portion, the bypass-side guiding portion is located at a position in a vertical direction that is equal to or higher than a position in the vertical direction of the bypass branch portion, and a part of the bypass-side guiding portion on the side of the check valve is located at a higher position in the vertical direction than a part of the bypass-side guiding portion on the side of the bypass branch portion, the high-stage side discharge pipe is provided with an oil separator to separate the lubricating oil from the refrigerant containing the mixed lubricating oil, and is connected to an oil return pipe that guides the lubricating oil separated by the oil separator to the low-stage side suction pipe, and the oil return pipe is connected to the low-stage side suction pipe at a connection portion that is positioned in the low-stage side suction pipe from the bypass branch portion to the refrigerant suction side of the low-stage side compressor.

8. A two-stage pressurizing refrigeration cycle, comprising:

a low-stage side compressor that compresses and discharges a refrigerant in which a lubricating oil is mixed;

a high-stage side compressor that compresses and discharges the refrigerant discharged from the low-stage side compressor;

a low-stage side suction pipe connected to a refrigerant suction side of the low-stage side compressor;

a low-stage side discharge pipe that connects a refrigerant discharge side of the low-stage side compressor to a refrigerant suction side of the high-stage side compressor;

a high-stage side discharge pipe connected to the refrigerant discharge side of the high-stage side compressor;

a bypass pipe branched from the low-stage side suction pipe and connected to the low-stage side discharge pipe, the bypass pipe being configured to guide the refrigerant to the high-stage side compressor while bypassing the low-stage side compressor when the low-stage side compressor stops; and a check valve provided in the bypass pipe, the check valve being configured to allow a flow of the refrigerant from the low-stage side suction pipe to the low-stage side discharge pipe, while blocking a flow of the refrigerant from the low-stage side discharge pipe to the low-stage side suction pipe, wherein the low-stage side suction pipe is provided with a bypass branch portion at which the bypass pipe is branched from the low-stage side suction pipe, the bypass pipe is provided with a bypass-side guiding portion to guide the lubricating oil from a side of the check valve to a side of the bypass branch portion, the bypass-side guiding portion is located at a position in a vertical direction that is equal to or higher than a position in the vertical direction of the bypass branch portion, and a part of the bypass-side guiding portion on the side of the check valve is located at a higher position in the vertical direction than a part of the bypass-side guiding portion on the side of the bypass branch portion, the high-stage side discharge pipe is provided with an oil separator to separate the lubricating oil from the refrigerant containing the mixed lubricating oil, and is connected to an oil return pipe to guide the lubricating oil separated by the oil separator to the bypass pipe, and the oil return pipe is connected to the bypass pipe at a connection portion that is positioned in the bypass pipe from the bypass branch portion to the check valve.

* * * * *